US009340755B2

(12) United States Patent
Gaudreault

(10) Patent No.: US 9,340,755 B2
(45) **Date of Patent: *May 17, 2016**

(54) HARD SURFACE CLEANING COMPOSITION FOR PERSONAL CONTACT AREAS

(71) Applicant: Jelmar, LLC, Skokie, IL (US)

(72) Inventor: Rosemary Gaudreault, Park Ridge, IL (US)

(73) Assignee: Jelmar, LLC, Skokie, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/039,826

(22) Filed: Sep. 27, 2013

(65) Prior Publication Data

US 2014/0024572 A1 Jan. 23, 2014

Related U.S. Application Data

(63) Continuation-in-part of application No. 12/927,370, filed on Nov. 12, 2010, now Pat. No. 8,575,084.

(51) Int. Cl.

| | |
|---|---|
| ***C11D 1/75*** | (2006.01) |
| ***C11D 3/20*** | (2006.01) |
| ***C11D 3/43*** | (2006.01) |

(52) U.S. Cl.

CPC ..... *C11D 3/2086* (2013.01); *C11D 1/75* (2013.01); *C11D 3/2068* (2013.01); *C11D 3/2079* (2013.01); *C11D 3/2082* (2013.01); *C11D 3/43* (2013.01)

(58) Field of Classification Search

CPC ..... C11D 1/75; C11D 3/042; C11D 3/2068
USPC ..... 510/238, 239, 240, 253, 433, 434, 503, 510/506

See application file for complete search history.

(56) References Cited

U.S. PATENT DOCUMENTS

| | | | | |
|---|---|---|---|---|
| 6,740,626 | B2 * | 5/2004 | Neumiller | 510/109 |
| 8,569,220 | B2 * | 10/2013 | Gaudreault | 510/253 |
| 8,575,084 | B2 * | 11/2013 | Gaudreault | 510/253 |
| 2003/0019508 | A1 * | 1/2003 | Tomarchio et al. | 134/6 |
| 2012/0122756 | A1 * | 5/2012 | Gaudreault | 510/477 |

OTHER PUBLICATIONS

Jelmar, LLC, Material Safety Data Sheet for CLR Bath and Kitchen Cleaner Enhanced Formula-Dfe, MSDS ID: 130910, pp. 1-5, Aug. 2010.*

* cited by examiner

*Primary Examiner* — Brian P Mruk

(74) *Attorney, Agent, or Firm* — Richard D. Harris; Greenberg Traurig, LLP

(57) ABSTRACT

A hard surface cleaning solution having improved cleaning and descaling properties. In an embodiment, the cleaning solution comprises an organic acid, a surfactant, a solvent and a diluent. The organic acid is a carboxylic acid, preferably lactic acid, while the surfactant is selected from the group consisting amine oxides, and the solvent is an alkoxylated alcohol, preferably selected from the propylene glycol ether class of compounds. The cleaning solutions may also include other components such as colorants, fragrance enhancers, corrosion inhibitors, nonionic surfactants or other additives.

21 Claims, No Drawings

HARD SURFACE CLEANING COMPOSITION FOR PERSONAL CONTACT AREAS

RELATED APPLICATION

This is a continuation-in-part application of co-pending U.S. patent application Ser. No. 12/927,370, filed on Nov. 12, 2010, now U.S. Pat. No. 8,575,084.

BACKGROUND OF THE INVENTION

1. Field of the Invention

The present invention relates in general to an improved cleaner for hard surface cleaning applications, including kitchens, bathrooms, tubs and tiles, amongst others, and more particularly to a hard surface cleaning composition for such personal contact areas, having improved cleaning and descaling properties.

2. Background of the Technology

Hard surface cleaning compositions have been known and used in a variety of applications, including bathrooms, kitchens and other areas, particularly for toilets, showers, bathtubs, sinks, tiles, countertops, walls, floors and the like. Often times, hard surfaces accumulate both soap scum stains, which are typically residues of various types of soaps used in a household, as well as hard water stains, which are typically the result of the deposition of calcium, lime or various salts on hard surfaces over the course of time and use of various household surfaces.

Cleaning solutions for these household surfaces have been formulated to address both the removal of soap scum stains, as well as the descaling of hard water stains. In particular, many of these cleaning solutions have employed a combination of components, in a number of instances including strong inorganic acids, organic acids or a combination of both, a surfactant or wetting agent, a solvent and a diluent to address one or both of these types of stains and/or build-ups. The acid component is typically selected to address descaling of hard water stains, while the surfactant component is typically a detergent selected to attack soap scum. Further, other additives have also been used in combination with cleaning formulations to either enhance performance or make a particular formulation more desirable from a visual or odor perspective, such as pH adjusters, stabilizing agents, colorants and fragrances, amongst others.

It has also become important for cleaning solutions to be formulated in such a way as to have less impact on the environment (to be "green"). One way in which this is encouraged is through a program of the United States Environmental Protection Agency, known as the Design for the Environment Program ("DfE"). DfE certifies "green" cleaning products through the Safer Product Labeling Program. One aspect for obtaining certification is to have a cleaning solution which is less acidic, specifically, to have a pH greater than 2, for household cleaning products. Furthermore, the standards adopted by governmental agencies, or sought by consumers, have been evolving. In the future, governmental standards may require, and/or consumers may demand, even stricter standards regarding the environmental compatibility of effective hard surface cleaning solutions. While it is unknown exactly how or when changes to these standards will occur, it is believed that any such change would adhere to stricter environmental standards, requiring ever "greener" cleaning products. One such change could be the pH level of the cleaning solution, requiring the pH level to be substantially higher than the current minimum requirement of 2.0.

Accordingly, It is desirable to provide a cleaning solution which minimizes and/or eliminates the more corrosive inorganic acids, as well as the more corrosive organic acids, and instead uses less corrosive, but equally effective organic acids to achieve the desired cleaning results.

It is yet further desirable to find a cleaning solution with a specific combination of organic acids, surfactants and solvents which act in a synergistic manner to improve cleaning performance on hard surfaces.

It is also desirable to provide a cleaning solution which is more environmentally compatible, such as by having a higher pH than in existing cleaning solutions configured for comparable uses.

It is further desirable to provide a cleaning solution which uses quantitatively less of the active ingredients, as compared to known cleaning solutions, but having comparable performance, so as to be more economically desirable.

SUMMARY OF THE INVENTION

The present invention comprises a hard surface cleaning solution which comprises an organic acid; a surfactant; a solvent; and a diluent; wherein the solution has a pH level ranging from about 2.0 to about 3.17; and wherein the surfactant does not contain salt in an amount sufficient to materially affect the pH level of the solution.

In one preferred embodiment of the invention, the organic acid comprises a carboxylic acid selected from the group consisting of lactic acid, formic acid, citric acid and acetic acid. In a preferred embodiment of the invention, the carboxylic acid is lactic acid.

In another preferred embodiment of the invention, the surfactant comprises an amine oxide. In a preferred embodiment of the invention, the amine oxide is lauramine oxide.

In another preferred embodiment of the invention, the solvent is a propylene glycol ether, preferably propylene glycol (mono) butyl ether.

In these embodiments of the invention, the diluent is water.

In such a preferred embodiment of the invention, the acid comprises about 6.93 wt. % to about 7.52 wt. % of the active cleaning composition; the surfactant comprises about 2.25 wt. % to about 2.5 wt. % of the active cleaning composition; the solvent comprises about 1.40 wt. % of the active cleaning composition; and the diluent comprises substantially the remainder of the cleaning composition.

In another preferred embodiment of the invention, the solution has a pH level of about 2.2 to about 3.37, after the cleaning solution has been aged a minimum of six months.

In another preferred embodiment of the invention, the solution descales marble test tiles about 1.586% to about 2.918%.

In another preferred embodiment of the invention, the solution does not contain bleach in an amount to materially affect the descaling ability of the solution, or cause the formation of noxious gases.

DETAILED DESCRIPTION OF THE INVENTION

While this invention is susceptible of embodiment in many different forms, there is described a specific embodiment with the understanding that the present disclosure is to be considered as an exemplification of the principals of the invention and is not intended to limit the invention to the embodiments so described.

The present invention is directed to a liquid cleaning solution which is particularly suited for removing soap scum, hard water stains, lime scale and the like from various hard surfaces such as tubs, tiles, showers, sinks and other areas which are exposed to water and soap. The invention includes different embodiments, including a cleaning solution which is a more vigorous solution more suitable for removing hard water stains, lime scale and rust, as well as another cleaning solution which is more suitable as an every day cleaner for removing soap scum, hard water spots and associated calcium deposits as well as lime scale.

A cleaning solution that has been commercially sold, in the past, by Jelmar, Inc. under the brand name CLR Bathroom and Kitchen Cleaner, has the following constituents: water, L(+)-Lactic Acid (at 9.24 wt. % of the active composition), Lauryl Hydroxysultaine (at 3.0 wt. % of the active composition), Propylene Glycol (Mono) Butyl Ether, and Fragrance. The pH is approximately 1.85.

In a preferred embodiment of one embodiment of the present invention, the cleaning solution comprises a chelating agent, a surfactant, a solvent and a diluent. A second chelating agent is not necessary or desired, as this cleaning solution is primarily contemplated as serving as a daily cleaner for sinks, tiles and tubs, towards the removal of calcium and lime stains, amongst others, rather than a more acidic, stronger cleaner for removal of tougher calcium, lime and rust stains.

The chelating agent is an organic acid, and preferably a carboxylic acid present in an amount of about 5.0 wt. % to about 10.0 wt. % of the active formula. More preferably, the first organic acid comprises lactic acid in an amount of 6.93 wt. % of the solution, which is sold under the brand name Sanilac 88 and can be purchased from Purac America, headquartered in Lincolnshire, Ill. Sanilac 88 is FIFRA (Federal Insecticide, Fungicide, and Rodenticide Act) approved as an antimicrobial agent. An alternative lactic acid, also from Purac, which may be employed in the cleaning composition of the present invention is Purac 88-T, though that is not FIFRA approved at the time of this application.

Other carboxylic acids which are contemplated for use with the cleaning solution of the present invention include glycolic acid, formic acid, citric acid and acetic acid. Of course, one of ordinary skill in the art with the present disclosure before them will readily appreciate that other carboxylic acids may also be used within the scope of the present invention.

A surfactant is provided, preferably an amine oxide, present in the cleaning solution in an amount of about 1.50 wt. % to about 4.0 wt. %. Preferably, the surfactant is lauramine oxide (also alternatively known as lauryldimethylamine oxide, dodecyldimethylamine oxide, or dimethyldodecylamine-N-oxide) present in about 2.25 wt. % of the active formula. Lauramine oxide can be purchased under the trade name Mackamine LO from Rhodia, located in Cranbury, N.J. Other alternative sources of lauramine oxide are Macat AO-12 (from Mason Chemicals) and Ammonyx LO (from Stepan Chemical). Commercially available LO is notable because it does not contain any salt (NaCl) as a result of the production process nor does the chemical itself contain a sodium component. It is believed that surfactants that contain salt (NaCl), or sodium (Na), either as an element of the fundamental surfactant molecules, or as a production byproduct, can have a tendency to suppress the pH of the resulting cleaning solution, even when the pH of the surfactant constituent itself is fairly high (>9 or 10). However, it has also been noted that even using surfactants that clearly lacked a sodium component, either as an element in the fundamental surfactant molecule, or as part of a production byproduct, such as glycosides, which also had a high initial pH, likewise failed to elevate the pH of the final cleaning solution, when the other constituents were as set forth in Table 1 hereinbelow. Only amine oxides, particularly lauramine oxide, were found to elevate the pH to DfE certification levels (a pH of 2.0 or higher), while at the same time providing comparable cleaning performance as the reference prior art cleaning solution mentioned above.

The solvent is an ether alcohol based solvent, and preferably an alkoxylated glycol. More preferably, the solvent is selected from a group of propylene glycol ethers, such as dipropylene glycol methyl ether, tripropylene glycol methyl ether, dipropylene glycol normal butyl ether and propylene glycol normal butyl ether. A preferred solvent is a propylene glycol (mono) butyl ether, sold under the trade name Dowanol PnB manufactured by Dow Chemical Company, headquartered in Midland, Mich. The solvent is preferably present in the cleaning solution in the range of about 0.50 wt. % to about 3.0 wt. % of the active formula, and most preferably in an amount of about 1.4 wt. % of the active formula.

The diluent is preferably deionized water, which is present in a range of about 82.85 wt. % to about 92.93 wt. % active in the cleaning solution formula. More preferably, the diluent comprises about 89.32 wt. % of the active cleaning formulation.

The surfactant in a cleaning solution performs a very important function, which is acting to physically separate a contaminating substance, from the surface to which the contaminating substance is adhered. Then, in such a cleaner, the acids function to attack and dissolve calcium and lime (which refers generally to calcium oxide and calcium hydroxide) deposits as well as rust (iron oxide) deposits. The solvents (e.g., an ether alcohol) can dissolve other contaminants, such as oils and greases.

The hard surface cleaning solution according to the present invention may further include an additive selected from the group consisting of colorants, fragrance enhancers, nonionic surfactants, corrosion inhibiting agents, defoamers, pH stabilizers and stabilizing agents. A colorant is particularly preferred in one embodiment of the present invention.

For example, the cleaning solution may also include a fragrance enhancing component, which may comprise any one of a wide variety of known fragrance additives, to impart a desired fragrance to the cleaning solution. One preferred example is Lavender Fragrance No. 313-046 purchased from Alpine Aeromatics in Piscataway, N.J. This provides the cleaning solution with a pleasant, fragrant odor, which can overcome the less desirable odors of the acid and/or other components of the formulation. The fragrance is preferably added in an amount of approximately 0.07 wt. % to about 0.15 wt. %.

The cleaning solution according to the present invention is less acidic than comparable existing cleaning solutions. In particular, cleaning solutions according to the present invention have been shown to have a pH, across the ranges of surfactant previously described, of 2.20-2.50, which enables it to obtain US DfE certification as an environmentally friendly or "green" cleaning solution product. This has been attained without significantly adversely affecting the descaling or rust removal capacity of the cleaning solution.

The cleaning solutions according to the present invention are typically bottled in plastic containers, and used by spraying or wiping the cleaning composition onto the surface of a tub, tile, sink or shower to be cleaned.

The following example below illustrates an exemplary formulation of the cleaning composition according to the present invention. It is to be understood that the example is presented by means of illustration only and that further use of formulations that fall within the scope of the present invention and the claims herewith may be readily produced by one skilled in the art with the present disclosure before them.

An embodiment of the present invention comprises a cleaning solution having the components listed below in the indicated proportions.

TABLE 1

| Ingredient Name | % Active in Raw Material | % in Formula | % Active in Formula | Chemical Class/Function |
|---|---|---|---|---|
| Deionized Water | | 83.12 | | Diluent |
| Sanilac 88 Lactic Acid | 88 | 7.88 | 6.93 | Organic Acid; Chelating Agent |
| Mackamine LO Lauramine Oxide (aka lauryldimethylamine oxide, dodecyldimethylamine oxide, DDAO or dimethyldodecylamine-N-oxide) | 30 | 7.50 | 2.25 | Surfactant; Wetting Agent |
| Dowanol PnB Propylene Glycol (Mono) Butyl Ether | 100 | 1.40000 | 1.40 | Solvent |
| Lavender Fragrance #313-046 | 100 | 0.10 | 0.10 | Gives a pleasant odor |

An example of a process for making the cleaning solution of the present invention incorporates the following steps, with the quantities of the several constituents being sufficient (and readily ascertainable by one of ordinary skill in the art) to achieve the percentages provided in the table above. The process begins with charging deionized water into a stainless steel tank equipped with a mixer. Lactic acid, in the form of Sanilac 88, is then added to the deionized water in the stainless steel tank. Next, lauramine oxide, in the form of Mackamine LO, will be added to the stainless steel tank from below the surface of the liquid in the tank to minimize foaming. It is preferred to pump the lauramine oxide surfactant in through the bottom of the tank. After the contents of the tank are mixed thoroughly, the propylene glycol (mono) butyl ether solvent is added into the stainless steel tank in the form of Dowanol PnB. Finally, Lavender #313-046 fragrance enhancer may be added to the mixture to achieve the desired odor, and the mixture is mixed until it is homogeneous. Notably, the sequence of addition of the components of the cleaning formulations is believed to be important, as a hazy product may result if the sequence is broken.

Testing of Example Cleaning Solution Formulation

The hard surface cleaning solution of the present invention was evaluated for scum removal efficacy, as well as for descaling efficacy. The cleaning formulations was each subjected to testing by an independent laboratory to measure the formulation's ability to remove soap scum and to remove hard water scale.

The Cleaning Solution of the present invention and prepared as described hereinabove, and with the composition detailed in the Table 1 above, and in accordance with a preferred embodiment of the present invention, was subjected to a standard CSPA DCC-16 Part 2 Scrubber Test for the Measuring the Removal of Lime Soap. The Cleaning Solution Formulation was compared against a leading commercial calcium, lime and rust hard surface cleaning solution sold by Jelmar Corporation of Skokie, Ill. under the brand name CLR Bathroom and Kitchen Cleaner.

The CSPA (Consumer Specialty Products Association) DCC-16 Part 2 Scrubber Test for the Measuring the Removal of Lime Soap is a visual test based upon a cleaner's ability to remove soap scum from plate tiles. Generally, tiles are plated with material which causes the formation of soap scum and baked. The tiles are then scrubbed pursuant to standard procedures with each of Jelmar's CLR Bathroom and Kitchen Cleaner commercial formulation and the Cleaning Solution 1 of the present invention. The ability of each cleaner to remove soap scum is then graded both visually as well as by instrumentation, such as a colorimeter, and graded as an average % of the scum removed from the tiles.

The instrumentation results of the CSPA DCC-16 Part 2 Scrubber Test for the Measuring the Removal of Lime Soap for the Cleaning Solution of the present invention are shown below in the following Table 2:

TABLE 2

| | |
|---|---|
| Commercial CLR Bathroom and Kitchen Cleaner | 64.7% removal |
| Cleaning Solution 1 | 62.8% removal |

The Purac 1998-10-04 Descaling Test is a weight-based test which measures the amount of calcium carbonate a cleaner removes from a hard surface. Generally, cubes of marble are scaled with calcium carbonate and weighed. The cubes are placed into solutions of the cleaning formulations being tested for a set time interval. The cubes are then removed from the respective cleaning solutions, allowed to dry and then weighed. Any weight loss indicates removal of calcium carbonate from the marble cubes, and thus descaling capability, measured in a percentage.

The results of the descaling testing on the Cleaning Solution of the present invention are show below in Table 3. The descaling percentages for the Cleaning Solution are computed as the average performance of 1 cube at each of 45 and 120 seconds.

TABLE 3

| | 45 Secs | 120 Secs |
|---|---|---|
| Commercial CLR Bathroom and Kitchen Cleaner | 0.1322% | 0.2441% |
| Cleaning Solution | 0.1616% | 0.2549% |

The above test results by independent laboratories demonstrate that the cleaning solution that is the subject of the present invention exhibits improved soap scum and scale removal properties over a leading commercial hard surface cleaning formulation. The Cleaning Solution Formula performed comparably at removing soap scum stains in the standard CSPA DCC-16 Part 2 Scrubber Test than one of the leading commercial calcium, lime and rust bathroom and kitchen surface cleaners. Likewise, the Cleaning Solution of the present invention exhibited significantly increased calcium carbonate removal during the Purac 1988-10-04 Descaling Test, than one of the leading commercial bathroom and kitchen cleaners, indicating improved performance in addressing hard water stains.

In addition to having an elevated pH relative to the existing CLR Bathroom & Kitchen cleaning product, the cleaning solution of the present invention is also less expensive to make, inasmuch as 25% less acid and 25% less surfactant (in terms of wt. % of the active solution) are required to obtain comparable, and even improved performance. It is believed that the cost of making the cleaning solution of the present invention may be as much as 19% less than the existing CLR Bathroom & Kitchen cleaning product.

Corrosion testing—unlike lauryl hydroxysultaine, lauramine oxide contains no sodium. LHS contains typically about 7% salt, as a production byproduct. Accordingly, the cleaning solution of the present invention is believed to be less corrosive than the existing CLR Bathroom & Kitchen cleaning product, as well.

Range of pH Levels and Descaling Ability

The maximum pH level of the solution of Table 1 above, is about 2.5. However, upon varying the relative concentrations of each ingredient in the formula, the hard surface cleaning solution of the present invention may have an even greater pH level, while still effectively removing soap scum together with calcium and lime from hard surfaces. A hard surface cleaning solution having a higher pH level may be required by future regulations or environmental standards, or may be preferred by consumers who prefer a less acidic compound with which to effectively remove calcium and lime. Table 4 sets forth further compositions of the present invention, their pH levels, and their respective results from descaling testing, using a descaling testing method that is described below. Each formula below was created using lactic acid (Purac 88) as the organic acid, and the surfactant lauramine oxide (Mackamine LO), which were added in the concentrations given below. Each solution further contains the same amount of solvent Dowanol PnB, 1.4%, with the remainder of each solution made up of the diluent, deionized water.

TABLE 4

| Formula No. | Organic Acid, % | Lauramine Oxide, % | pH | Descale, % |
|---|---|---|---|---|
| JEL-1797 | 7.52 | 0.50 | 2.07 | 2.918 |
| JEL-1789 | 7.52 | 1.00 | 2.16 | 2.885 |
| JEL-1590 | 7.52 | 2.50 | 2.42 | 2.681 |
| JEL-1793 | 7.52 | 3.50 | 2.59 | 2.468 |
| JEL-1798 | 7.52 | 5.00 | 2.79 | 2.194 |
| JEL-1816 | 7.52 | 6.25 | 2.96 | 1.850 |
| JEL-1814 | 7.52 | 7.50 | 3.17 | 1.586 |

Each of the solutions above were tested for both their pH level, and descaling ability. The pH level was determined by a pH meter (Corning pH Meter 440 with Corning Pinnacle 3 in 1 Premium Gel Combo Electrode, Corning Inc., Corning, N.Y.) on formulations tested shortly after creation—that is formulations that were not aged. The descaling tests in Table 4 were performed according to a different method from the STR test method described above, the results for which are shown in Table 3. For Table 4, the descaling tests were performed upon marble test blocks, namely Crema Tumbled Marble Tiles, 9/16"×9/16"×3/8". Marble was chosen because it contains calcium carbonate, or limestone. Thus, solutions that descale calcium and lime, must also react with marble and dissolve a portion of it into solution. Before testing, the blocks were prepared by washing them in distilled water, and drying them in an oven at 120° C. (248° F.). The blocks were then stored in a closed jar to prevent the absorption of moisture before testing. When ready for testing, the blocks were weighed, and placed in a beaker with 15 g of identified cleaning solution being tested. After 5 minutes, the blocks were removed from the cleaning solution being tested, patted dry, and washed several times with distilled water to remove any remaining cleaning solution. Then, the blocks were dried in an oven at 105° C. (221° F.) for an hour to remove moisture, and allowed to cool for another hour before weighing. The percentage of descaling was calculated through the difference in weight of the marble block, before and after testing, as follows:

$$\text{Descale},\% = (\text{Initial Weight} - \text{Final Weight}) \times 100 / \text{Initial Weight}$$

Each of the cleaning solutions of Table 4 were also evaluated for soap scum removal, in a qualitative test described below. Lightly colored (off white), low gloss, 2"×2" ceramic tiles were coated with a heavy solution of 50% Oil of Olay Anti-Aging Body Wash (Procter & Gamble Co., Cincinnati, Ohio) and 50% tap water, and then set aside for two weeks to dry, to simulate the deposit of a layer of soap scum. A paper towel was then soaked in the tested cleaning solution for 3 seconds, and then immediately applied to the soiled tile, and scrubbed for 10 seconds. The tile was then wiped by a dry paper towel for another 10 seconds, and set aside to dry for 12 hours before inspection under good light. Each of the cleaning solutions of Table 4 were found to completely remove the soap scum from the tiles, under these parameters.

As noted above in Table 4, the cleaning solutions each descaled the marble blocks, to varying degrees. The formula used in the third solution, JEL-1590, while not exactly the same, closely matches that of Table 1, the commercially available CLR® Bathroom and Kitchen Cleaner by Jelmar, Inc., which is well known to effectively descale calcium and lime. In comparison to this formula, descaling ability decreased when tested against solutions of higher pH levels, and, conversely, increased when tested against solutions of lower pH levels. While a higher descaling performance is preferable, there may be other considerations in choosing the appropriate ingredient concentrations of the cleaning solution, including the relative cost of each ingredient, the level of descaling that is necessary, and the pH level of the cleaning solution. Notably, if the standards for pH levels were to increase, or if consumers' preferences should change towards using a less acidic hard surface cleaning solution, the concentrations of the ingredients of the present invention cleaning solution may be altered to still provide an effective hard surface cleaning solution, one that is effective at both removing soap scum as well as descaling calcium and lime.

pH Levels Drift Higher Over Time

The pH levels of the cleaning solutions of the present invention have been observed to change over time. Namely, the pH levels have been observed to drift higher, with aging of the cleaning solution itself. In accord with convention, the pH levels disclosed in Table 4 in the present application and the claims hereto (unless otherwise distinguished), as well as those disclosed in Table 1, all refer to the pH levels of the solutions as measured when each solution was first created. However, solutions that are stored six months or longer, and have been measured at that time, have been observed to have a higher pH level, than the pH level, as measured when the solution was first created. To quantify the unexpected shift in pH level, different solutions of the present invention have been oven-aged to simulate the effects of storage for a longer period of time at room temperature, as shown in Table 5 below.

TABLE 5

| Formula No. | Initial pH | Oven-Aged pH |
|---|---|---|
| Cleaning Solution Formulation 2 | 2.4 | 2.7 |
| JEL-1814 | 3.17 | 3.37 |

Cleaning Solution Formulation 2 is a version of cleaning solution that has been sold commercially as CLR® Bathroom and Kitchen Cleaner by Jelmar, Inc. The composition of JEL-1814, also of the present invention, has a composition that is described above in association with Table 4. As noted above, both solutions are capable of removing calcium and lime, at different degrees, as well as soap scum, to the same degree. To simulate aging, each of the solutions was placed in an oven for 19 days at 50° C. Oven-aging at 40° C. has been used to simulate the aging of cosmetic products at a rate of eight times the actual time at room temperature. Oven-aging at 50° C. has been used to simulate aging at a rate that is 50% higher than aging at 40° C., or twelve times the actual time at room temperature. Therefore, 19 days at 50° C. simulates the aging of the solutions, for approximately 7½ months. This simulated result was confirmed by testing CLR® Bathroom and Kitchen Cleaner solutions that had actually been aged more than six months, at room temperature, whose pH levels were similarly found to rise by about 0.2-0.3 units of pH.

Testing of Additional Constituents

Additional constituents were added to the hard surface cleaning solution of the present invention to determine their effect on the solution. Hydrogen peroxide bleach was added to the JEL-1590 formula disclosed above, in a concentration of 2.00% $H_2O_2$. Following the addition of peroxide, the solution suddenly appeared cloudy, or hazy. This is believed to be the result of a reaction between the hydrogen peroxide, a powerful oxidizing agent, and one or more of the constituents of the hard surface cleaning solution. After adding the peroxide, the pH of the resulting solution hardly changed, from 2.42 to 2.43. More notably, the descaling ability of the solution decreased, from 2.681% to 2.432% in marble block testing, for a decrease of 9.3%. It is believed that this occurs because the hydrogen peroxide reacted with the surfactant lauramine oxide to form lauric acid or a derivative thereof. The reduction of descaling ability is attributed to the loss of surfactant lauramine oxide, which appears to play a significant role in descaling at this pH level. Thus, the addition of hydrogen peroxide bleach is also not recommended.

Further, sodium hypochlorite bleach was added to the JEL-1590 formula disclosed above. Two ml of Clorox® bleach (The Clorox Company, Oakland, Calif.) containing 8.25% sodium hypochlorite were added to 60 ml of the JEL-1590 formula, in a well-ventilated area. A reaction was witnessed upon the addition of the bleach, which resulted in what was believed to be the production of chlorine gas. A noxious gas emitted from the solution, that, despite all of the precautions taken, was still pungent and irritating to the upper respiratory tract and eyes. Such an experiment should not be repeated outside of a highly ventilated hood. Thus, one should avoid adding any chlorine bleach, such as sodium hypochlorite, to the hard surface cleaning solution of the present invention.

The foregoing description merely explains and illustrates the invention, and the invention is not limited thereto, except as those skilled in the art who have the present disclosure before them will be able to make modifications and variations therein without departing from the scope of the invention.

The invention claimed is:

1. A hard surface cleaning solution for descaling calcium and lime, comprising:

an organic acid comprising a carboxylic acid selected from the group consisting of lactic acid, formic acid, citric acid and acetic acid;

a surfactant selected from the group consisting of amine oxides;

a solvent selected from the group consisting of ether alcohols; and a diluent;

in which the solution has a pH level ranging from about 2.59 to about 3.37; and wherein the surfactant does not contain salt in an amount sufficient to materially affect the pH and the descaling ability of the hard surface cleaning solution.

2. The hard surface cleaning composition according to claim 1, wherein the organic acid is present in the solution in an amount of 5.0 wt. %-10.0 wt. % of the active cleaning composition.

3. The hard surface cleaning composition according to claim 2, wherein the organic acid is present in the solution in an amount of about 6.93 wt. % to about 7.52 wt. % of the active cleaning composition.

4. The hard surface cleaning composition according to claim 1, wherein the surfactant is present in the solution in an amount of about 0.5 wt. %-7.5 wt. % of the active cleaning composition.

5. The hard surface cleaning composition according to claim 4, wherein the surfactant is present in the solution in an amount of about 2.25 wt. % to about 2.50 wt. % of the active cleaning composition.

6. The hard surface cleaning composition according to claim 1, wherein the solvent is present in the solution in an amount of about 0.50 wt. % to about 3.00 wt. % of the active cleaning composition.

7. The hard surface cleaning composition according to claim 6, wherein the solvent is present in the solution in an amount of about 1.40 wt. % of the active cleaning composition.

8. The hard surface cleaning solution of claim 1, wherein the diluent comprises about 82.9 wt. % to about 92.9 wt. % of the active cleaning composition.

9. The hard surface cleaning solution of claim 8 wherein the diluent comprises about 83.1 wt. % to about 88.6% of the active cleaning composition.

10. The hard surface cleaning solution of claim 1 wherein the organic acid comprises lactic acid.

11. The hard surface cleaning solution of claim 1 wherein the surfactant comprises lauramine oxide.

12. The hard surface cleaning solution of claim 1 wherein the solvent comprises a propylene glycol ether.

13. The hard surface cleaning solution of claim 12, wherein the solvent comprises propylene glycol (mono) butyl ether.

14. The hard surface cleaning composition of claim 1 further including an additive selected from the group consisting of colorants, fragrance enhancers, nonionic surfactants, corrosion inhibiting agents, defoamers, pH stabilizers and stabilizing agents.

15. The hard surface cleaning composition of claim 14 wherein the additive comprises a fragrance enhancer.

16. The hard surface cleaning solution of claim 1 in which said pH level ranges from 2.59 to about 3.17, as measured before aging.

17. The hard surface cleaning solution of claim 1 in which said pH level ranges from 2.59 to about 3.37, as measured after said cleaning solution has been aged a minimum of six months.

18. The hard surface cleaning solution of claim 1 wherein the solution descales marble test tiles in the range of about 1.586% to about 2.918%.

19. The hard surface cleaning solution of claim 1 wherein the solution does not contain bleach in an amount sufficient to materially affect the descaling ability of the solution.

20. The hard surface cleaning solution of claim 1 wherein the solution does not contain bleach in an amount to cause the formation of noxious gases.

21. A hard surface cleaning solution for descaling calcium and lime, comprising:

lactic acid, in an amount of about 5.0 wt. % to about 10.0 wt. % of the active cleaning composition;

an amine oxide, in an amount of about 0.50 wt. % to about 7.5 wt. % of the active cleaning composition;

a propylene glycol ether, in an amount of about 0.50 wt. % to about 3.0 wt. % of the active cleaning composition; and deionized water, in an amount of about 82.85% to about 92.93 wt. % of the active cleaning composition;

in which the solution has a pH ranging from 2.59 to about 3.17, as measured before aging; and wherein the surfactant does not contain salt in an amount sufficient to materially affect the pH and the descaling ability of the hard surface cleaning solution.

* * * * *